United States Patent [19]

Zanzig

[11] Patent Number: 5,072,233

[45] Date of Patent: Dec. 10, 1991

[54] LOOP ANTENNA WITH INTEGRAL TUNING CAPACITOR

[76] Inventor: Gary R. Zanzig, 16033 NE. Third St., Bellevue, Wash. 98008

[21] Appl. No.: 556,556

[22] Filed: Jul. 20, 1990

[51] Int. Cl.[5] ..... H01Q 7/00

[52] U.S. Cl. ..... 343/744; 343/748

[58] Field of Search ..... 343/743, 744, 748, 866

[56] References Cited

U.S. PATENT DOCUMENTS

| | | | |
|---|---|---|---|
| 2,059,299 | 11/1936 | Yolles | 343/744 |
| 3,176,299 | 3/1965 | Caraway | 343/744 |
| 3,550,137 | 12/1970 | Kuecken | 343/748 |
| 4,080,603 | 3/1978 | Moody | 343/744 |

OTHER PUBLICATIONS

*The ARRL Antenna Book,* published by The American Radio Relay League, Newington, Conn., 8th ed., 1956, p. 302.

*Primary Examiner*—Michael C. Wimer

*Attorney, Agent, or Firm*—Christensen, O'Connor, Johnson & Kindness

[57] ABSTRACT

Disclosed is a tunable loop antenna (20) in which the antenna tuning capacitor (36) is an integral component of the antenna structure. In each disclosed embodiment, the loop antenna is of square configuration with the ends of the conductor (22) that forms the antenna loop being spaced apart from one another. Capacitor plates (38 and 40) extend orthogonally from and coaxially surround each end of the loop conductor to thereby define a parallel plate capacitor in which spacing between the capacitor plates and, hence, the resonant frequency of the antenna is controlled by flexure of the antenna structure. Suspended between the capacitor plates is a dielectric plate (48). Dielectric grease (54) fills the gaps between the dielectric plate (48) and capacitor plates (38 and 40). A remotely operable motor-drive unit (54) facilitates tuning the antenna to a desired frequency.

11 Claims, 4 Drawing Sheets

LOOP ANTENNA WITH INTEGRAL TUNING CAPACITOR

TECHNICAL FIELD

This invention relates to antennas, and more particularly to loop antennas in which a variable capacitor is used to tune the antenna to a desired transmit and/or receive frequency.

BACKGROUND OF THE INVENTION

Loop antennas exhibit relatively narrow bandwidth and typically are tuned to a desired transmit and/or receive frequency by a variable capacitor. Prior art loop antennas that operate at relatively high power levels typically employ either an air variable or vacuum variable capacitor as the antenna tuning element.

Although commercially available air and vacuum variable capacitors provide satisfactory operation in some loop antenna applications, both types of capacitors often present disadvantages from the standpoint of size, weight and cost. In this regard, because the dielectric constant of air is relatively low, air variable capacitors suitable for tuning a loop antenna typically include a plurality of relatively large metal plates that are spaced apart from one another by a substantial distance in order to provide the required capacitance range and voltage breakdown rating. Although vacuum variable capacitors typically are smaller in size than comparable air variable capacitors, the cost is higher and other disadvantages are present. One factor that contributes to the higher cost of vacuum variable capacitors is the need to maintain satisfactory vacuum seals. Further, the vacuum variable capacitors typically use capacitor plates that are precisely machined and closely spaced from one another, thereby increasing cost. Moreover, because of the vacuum seal and close fitting capacitor plate structure, vacuum variable capacitors are relatively delicate.

In addition to cost and size disadvantages, commercially available air and vacuum variable capacitors often do not provide adequate voltage breakdown ratings for loop antennas that are used with high power transmitters. In this regard, when an air variable capacitor is used for tuning a loop antenna, the capacitor often must be operated below its voltage breakdown rating to allow for high ambient humidity and/or operation at high altitude. Vacuum variable capacitors can be especially disadvantageous in high power loop antenna applications. Specifically, interplate arcing that occurs upon voltage breakdown can vaporize affected portions of the capacitor plates thereby resulting in "barnacle" growth that permanently damages (or even destroys) the capacitor.

Moreover, achieving maximum antenna efficiency (low power loss) often is difficult with a loop antenna that employs a conventional air or vacuum variable capacitor. Specifically, the radiation resistance of a small loop antenna often is on the order of 0.1 ohms. Thus, high currents flow through the antenna structure during high power transmission. Accordingly, to prevent excessive loss of power (loss of antenna efficiency), the current path through the entire antenna must be very low in resistance.

Prior art loop antennas typically are formed of a rigid metal conductor and are in the shape of a square or other polygon (e.g., a hexagon). In such an arrangement, the air variable or vacuum variable antenna tuning capacitor typically is mounted in a gap or opening in one arm of the antenna. To minimize ohmic contact resistance (and hence power loss), the tuning capacitor generally includes relatively large electrical terminals that often are machined for flatness and may be gold or silver plated to minimize junction resistance when the capacitor terminals are bolted or otherwise connected to the antenna. Although these measures are helpful in minimizing junction resistance, the resistance and resulting power loss often is higher than desired. Further, machining and/or plating capacitor terminals further increases the cost of the tuning capacitor. Moreover, in situations in which the antenna is exposed to the environment, corrosion and loosening of the antenna-capacitor interconnections may occur thereby increasing the junction resistance. Even further, air variable and vacuum variable capacitors include internal electrical junctions, e.g., electrical connections between the capacitor plates and mounting elements within the capacitor. These internal electrical junctions present additional ohmic contacts that cause power loss and, hence, further decrease the efficiency of the antenna.

There is yet another disadvantage or drawback associated with using an air variable or vacuum variable capacitor as the tuning element of a loop antenna. Specifically, relatively high torque usually is required to tune air variable and vacuum variable capacitors that are suitable for use with a loop antenna that operates at high power levels. In the prior art, relatively complex control units that often include a stepping motor, a gear reduction unit and associated circuitry have been used to supply the torque required to drive the tuning capacitor. These control units not only increase the cost of the antenna system, but cannot rapidly tune the antenna to a desired frequency. Because of this tuning limitation, prior art loop antennas have not been suitable for use in applications such as secure communications systems that use burst-mode or frequency hopping techniques.

SUMMARY OF THE INVENTION

Provided in accordance with this invention is a loop antenna in which the antenna tuning capacitor is an integral component of the antenna loop. Specifically, in accordance with the invention, the conductive loop that serves as the radiating element of the antenna includes spaced-apart capacitor plates. The conductor forming the antenna loop is copper pipe or another material that provides a low-resistance current path while simultaneously establishing a semi-rigid, spring-like structure in which flexure of the semi-rigid antenna structure controls the distance between the capacitor plates (and, hence, controls the frequency to which the antenna is tuned).

In the disclosed embodiments of the invention, the loop antenna is of square configuration with the ends of the conductor that forms the antenna being located in one leg of the loop and being spaced apart from one another by a predetermined distance. Extending orthogonally from and coaxial with each end of the antenna conductor is a circular capacitor plate. In this configuration, the capacitor plates collectively form a parallel plate capacitor having a capacitance value that is determined by the capacitor plate area, the spacing between the capacitor plates, and the dielectric constant of the material between the capacitor plates. Since, as previously mentioned, the antenna loop is formed to be semi-rigid and have spring-like qualities, the capacitor plates can be urged away from and toward one another to vary the value of capacitance and thereby tune the antenna.

Suspended between the capacitor plates of the disclosed embodiments is a dielectric sheet having a thickness that is less than the spacing between the capacitor plates. A relatively viscous dielectric gel or grease fills the gaps between the capacitor plates and the surfaces of the dielectric sheet, with the dielectric gel extending outwardly beyond the periphery of the capacitor plates. The portion of the dielectric gel that extends beyond the periphery of the capacitor plates is drawn into the gaps between the capacitor plates when the capacitor plates are urged away from one another to tune the antenna to a higher frequency (the integral capacitor exhibits a lower capacitance value). Conversely, when the antenna is tuned to a lower frequency, the capacitor plates are moved toward one another (increased capacitance) and a portion of the dielectric gel is forced from the gaps onto the portion of the dielectric sheet that surrounds the periphery of each capacitor plate.

In the disclosed embodiments of the invention, rapid and accurate antenna tuning is provided by a battery-powered reversible electric motor that is mounted and arranged to move the capacitor plates away from and toward one another.

BRIEF DESCRIPTION OF THE DRAWING

The various features and advantages of the invention will be understood in view of the following detailed description taken in conjunction with the accompanying drawing in which.

DETAILED DESCRIPTION OF THE PREFERRED EMBODIMENT

Figure 1:
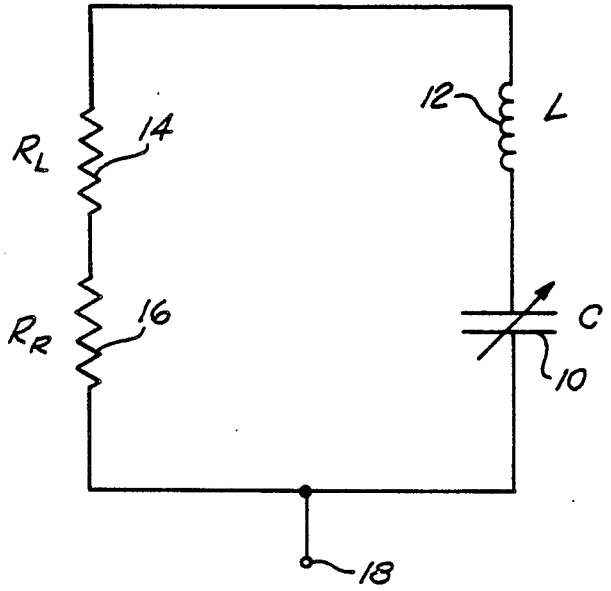
FIG. 1 is an equivalent circuit for a tunable loop antenna.

FIG. 1 is an equivalent circuit which is representative of both prior art loop antennas and a loop antenna constructed in accordance with the invention. Included in the depicted equivalent circuit of FIG. 1 are a variable capacitor 10, an inductor 12, a resistor 14, and a resistor 16 which are connected in series to form a continuous current path (i.e., a loop). In the equivalent circuit of FIG. 1, the antenna feed point is represented by a circuit input terminal 18. In this arrangement, inductor 12 represents the inductance of the loop antenna; capacitor 10 is the antenna tuning capacitor; resistor 14 represents the loop resistance, including ohmic junctions; and resistor 16 represents the radiation resistance of the antenna.

As is known in the art, the radiation resistance of a loop antenna (and, hence, the value of resistor 16 in FIG. 1) is exponentially related to the area enclosed by the loop antenna and, in addition, is exponentially related to the frequency at which the loop antenna is being operated. For relatively small area loop antennas, the radiation resistance typically is on the order of 0.1 ohm, when the antenna is operated at or near its resonant frequency.

As also is known in the art, the electrical efficiency of a loop antenna is the ratio (in percent) of the power radiated by the antenna to the total power applied to the antenna. Mathematically, the antenna efficiency thus can be represented as:

$$\eta = \frac{R_R}{R_R + R_L} \times 100\% \tag{1}$$

where $R_R$ represents the antenna radiation resistance (resistor 16 in FIG. 1) and $R_L$ (resistor 14 in FIG. 1) represents loop resistance, including the resistance of the conductors that form the antenna and the resistance of the ohmic contacts or junctions between component parts of the antenna.

In view of the relatively low radiation resistance of a loop antenna, it thus can be recognized that satisfactory antenna efficiency can only be achieved if antenna losses (i.e., the resistance value $R_L$) can be maintained at a very low level. For example, in prior art arrangements using air and vacuum variable capacitors, the resistance $R_L$ can be on the order of 1 ohm, thereby limiting antenna efficiency to less than 10%. As shall become apparent in view of the following paragraphs, loop antennas configured in accordance with this invention minimize both the number of and the resistance of ohmic contacts or junctions to thereby provide higher antenna efficiency than has been achieved in the prior art.

Figure 2:
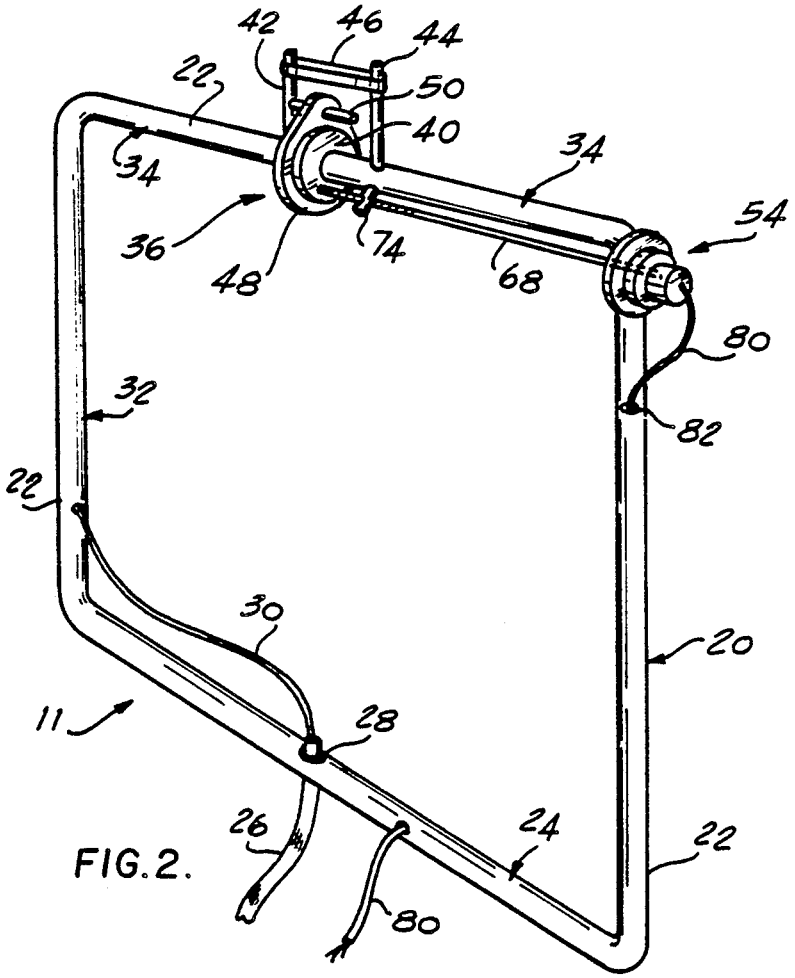
FIG. 2 is a pictorial view of a loop antenna that is constructed in accordance with the invention.

With reference to FIG. 2, the loop antenna 20 of this invention includes a tubular conductor 22 that is extruded or otherwise formed of copper or other material in which at least the outer surface exhibits relatively high electrical conductivity. In the depicted embodiment, antenna 20 is substantially square in overall geometry, with conductor 22 being a single piece of copper pipe that is bent or otherwise formed into a square-like loop. As will be recognized by those skilled in the art, a loop antenna constructed in accordance with the invention can form a circular, hexagonal, octagonal or other geometric pattern. Further, instead of being formed by a single conductor 22, antenna 20 can be formed by shorter lengths of suitable conductor that are electrically and mechanically connected to one another by silver braze welding or by other conventional low-resistance techniques.

Located along the lower leg 24 of the depicted antenna 20 is a coaxial cable 26, which electrically interconnects antenna 20 with a transceiver (not shown in FIG. 2). As is indicated in FIG. 2, the outer conductor of coaxial cable 26 is electrically connected to a feed point 28 that is located on lower leg 24 of antenna 20. Electrically connected to the center conductor of coaxial cable 26 is an electrical conductor 30 that extends to and is electrically connected to a selected point along upwardly extending leg 32 of antenna 20. As is known in the art, this method of interconnecting coaxial cable 26 to antenna 20 is a tapped impedance-matching technique in which the point at which conductor 30 is connected to upwardly extending antenna leg 32 is selected to minimize voltage standing wave ratio (VSWR). In the field of amateur radio, this particular impedance-matching technique often is referred to as a "gamma match."

Integrally formed in the horizontally extending upper leg 34 of antenna 20 is a variable capacitor 36, which is used to tune antenna 20 to a desired frequency. As is indicated in FIG. 2 and shown more clearly in FIG. 3, capacitor 36 includes two metal capacitor plates 38 and 40 which are spaced apart and substantially parallel to one another. In the currently preferred embodiments of the invention, capacitor plates 38 and 40 are circular in geometry and extend orthogonally from and concentrically about the oppositely disposed ends of conductor 22. As is indicated in both FIGS. 2 and 3, in the depicted embodiment, capacitor plates 38 and 40 are joined to the ends of conductor 22 by a low-resistance interconnection such as silver braze welding. Alternatively, capacitor plates 38 and 40 can be formed in the ends of conductor 22 by spinning or other known methods of mechanical fabrication.

Figure 3:
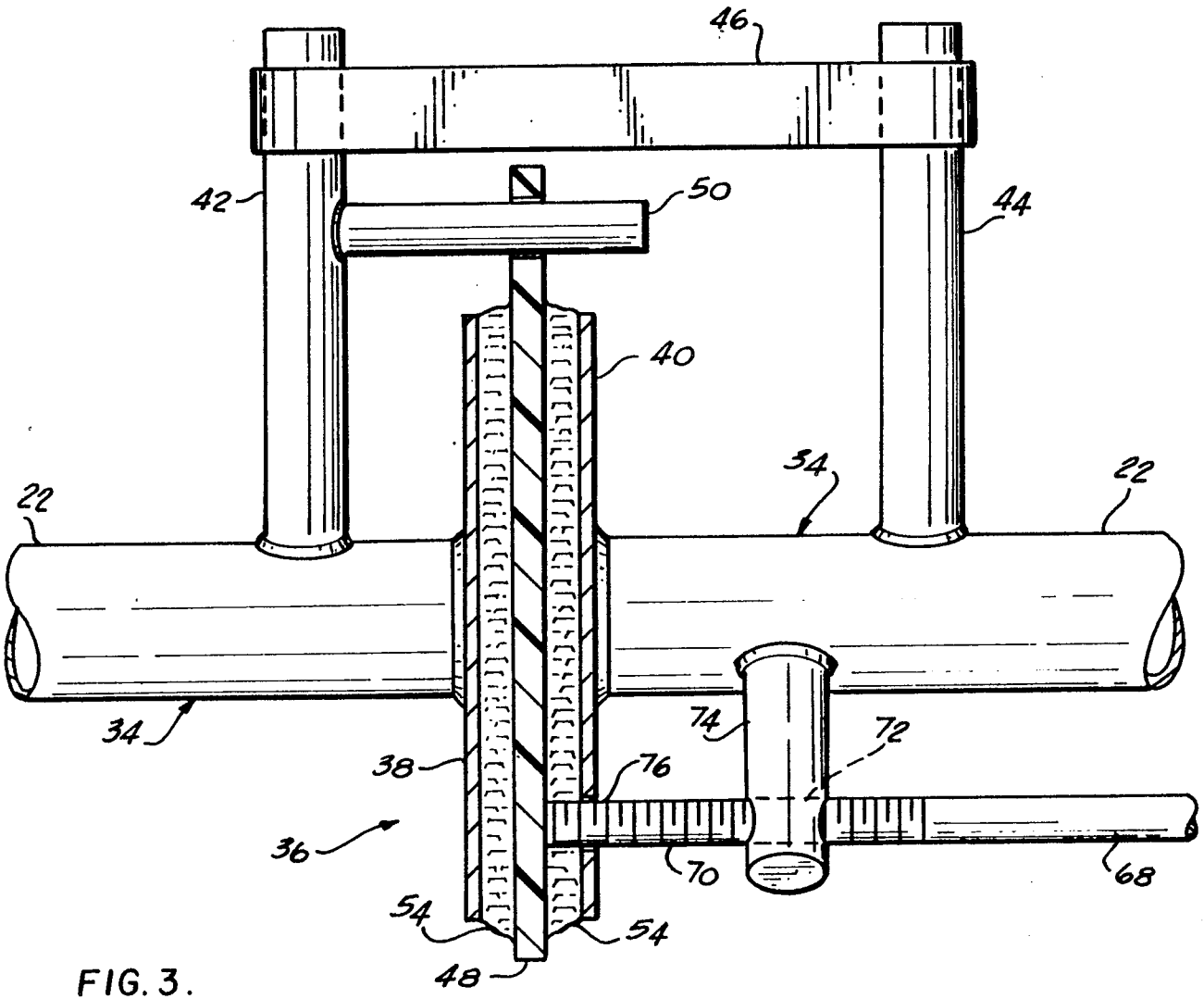
FIG. 3 is a more detailed pictorial view of the tuning capacitor portion of the loop antenna of FIG. 2.

Extending orthogonally from conductor 22 of horizontal antenna leg 34 is a pair of vertical spaced-apart posts 42 and 44, each of which is welded or otherwise joined to conductor 22. As is shown in FIGS. 2 and 3, post 42 is mounted to the portion of conductor 22 that is connected to capacitor plate 38 and is spaced apart from capacitor plate 38. Similarly, post 44 is spaced apart from capacitor plate 40 and is mounted to the portion of conductor 22 that is connected to capacitor plate 40. Encircling the upper portion of posts 42 and 44 is an elastic band 46 formed of rubber or other suitable nonconductive material. Elastic band 46 urges posts 42 and 44 toward one another, thus urging capacitor plates 38 and 40 into a quiescent, spaced-apart position in which capacitor 36 exhibits maximum capacitance value (minimum spacing between capacitor plates 38 and 40; minimum resonant frequency of loop antenna 20). As shall be described in more detail, to tune antenna 20 to a frequency above its minimum resonant frequency, capacitor plates 38 and 40 are urged away from one another to decrease the capacitance value of capacitor 36. Urging capacitor plates 38 and 40 away from one another causes flexure of antenna 20 that results in a spring-like restorative force being exerted on the capacitor plates 38 and 40 by conductor 22. This restorative force acts in combination with the tension asserted be elastic band 46 to dampen movement of capacitor plates 38 and 40 as they are being urged away from one another and thereby prevents tuning overshoot and/or oscillation about a desired tuning point. Conversely, when antenna 20 is tuned to a lower frequency (by decreasing the spacing between capacitor plates 38 and 40), elastic band 46 and the spring-like restorative force asserted by conductor 22 of antenna 20 cause the capacitor plates to smoothly move to the spacing required to resonate antenna 20 at the desired frequency.

Suspended between capacitor plates 38 and 40 of the embodiment shown in FIGS. 2 and 3 is a dielectric plate 48 that is substantially circular and exhibits a diameter greater than the diameter of capacitor plates 38 and 40. As is shown in both FIGS. 2 and 3, dielectric plate 48 is suspended from a support pin 50 that is mounted to post 42 and extends in spaced-apart, substantially parallel juxtaposition with horizontal leg 34 of antenna 20. The distal end of support pin 50 passes through an opening that is located in dielectric plate 48, with the opening being sized to allow dielectric plate 48 to freely slide along support pin 50 with its surfaces remaining substantially parallel to capacitor plates 38 and 40. Interposed in the gaps formed between capacitor plates 38 and 40 and the surfaces of dielectric plate 48 is a relatively viscous dielectric gel or grease 54. As is indicated in FIGS. 2 and 3, at minimum spatial separation between capacitor plates 38 and 40 (maximum capacitance; minimum resonant frequency of antenna 20), the dielectric grease 57 extends outwardly from the capacitor plates and onto the surfaces of dielectric plate 48. When the spacing between capacitor plates 38 and 40 is increased, a portion of the excess dielectric grease is drawn into the gaps between the capacitor plates 38 and 40 and the surfaces of dielectric plate 48.

It will be recognized by those skilled in the art that the capacitance value exhibited by capacitor 36 is dependent upon the area of capacitor plates 38 and 40, the thickness and dielectric constant of dielectric plate 48, the thickness of the gaps filled by dielectric grease 54 and the dielectric constant of dielectric grease 54. Although various materials can be used in the practice of the invention, currently preferred embodiments utilize a dielectric plate 48 and dielectric grease 54 having relatively high dielectric voltage ratings and substantially equal dielectric constants. For example, the currently preferred embodiments of the invention utilize a dielectric plate 48 that is constructed of polyethylene and a commercially available dielectric grease that is identified as Dow-Corning Insulating Compound No. 4. Although various other dielectric greases can be employed, dielectric grease 54 preferably exhibits viscosity and adhesion characteristics that maintain the dielectric grease as a uniform layer that is substantially devoid of air bubbles or other interruptions. Maintaining a full and uniform layer of dielectric grease 54 in the gap regions prevents voltage breakdown and ionization of air-filled voids that could otherwise exist in the gap regions. Moreover, since dielectric grease 54 extends beyond the periphery of capacitor plates 38 and 40, voltage breakdown along the edges of the capacitor plates is avoided. This provides high power capability for antenna 20, while simultaneously eliminating water and other contaminants that could provide low voltage breakdown paths.

In addition to providing a high voltage dielectric medium between dielectric plate 48 and capacitor plates 38 and 40, dielectric grease 54 provides damping when the spacing between capacitor plates 38 and 40 is varied to tune antenna 20. Specifically, when the spacing between capacitor plates 38 and 40 is increased to increase the resonant frequency of antenna 20 (decreased capacitance), adhesion of dielectric grease 54 to capacitor plates 38 and 40 and the surfaces of dielectric plate 48 and the attendant drawing of additional dielectric grease into the gap regions results in a force that resists increased displacement of capacitor plates 38 and 40. This resistive force aids the previously described resistive force of elastic band 46 and the spring-like restorative force of the antenna structure to prevent or minimize tuning overshoot and/or oscillation about the desired tuning point. On the other hand, when the spacing between capacitor plates 38 and 40 is decreased to tune antenna 20 to a lower frequency (increased capacitance), the force required to squeeze dielectric grease 54 from the gaps between capacitor plates 38 and 40 and dielectric plate 48 dampens relative movement of capacitor plates 38 and 40 to prevent or minimize tuning overshoot and/or oscillation about the desired tuning point.

Figure 4:
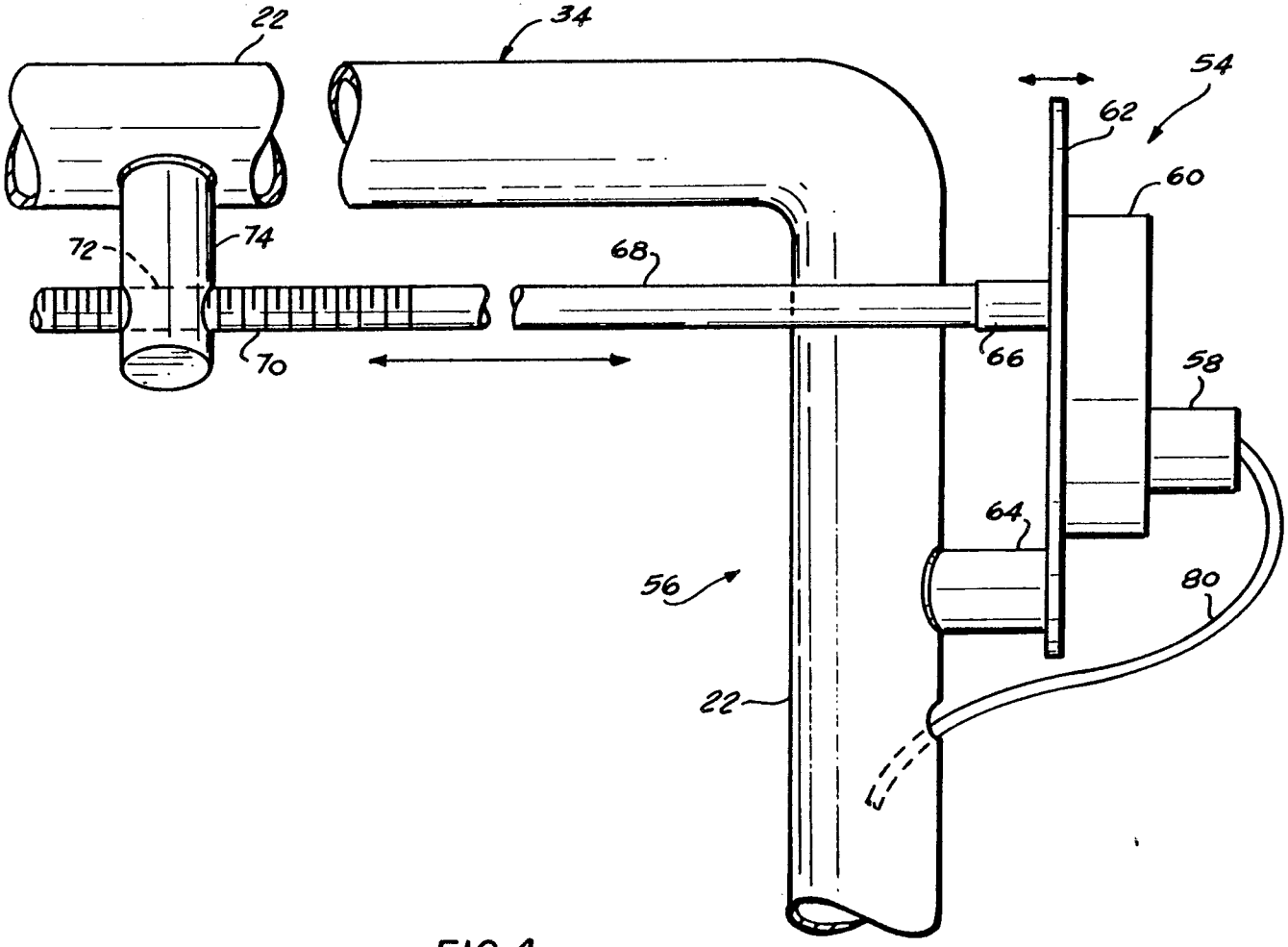
FIG. 4 is a more detailed pictorial view of the motor-drive assembly for the tuning capacitor of the loop antenna shown in FIG. 2.

As is indicate in FIGS. 2 and 4, spacing between capacitor plates 38 and 40 of the depicted embodiment (and, hence, the frequency to which antenna 20 is tuned) is controlled by a motor-drive assembly 54, which is mounted to vertically extending leg 56 of antenna 20 at a position near horizontally extending leg 34. As can be seen most clearly in FIG. 4, motor-drive assembly 54 includes a reversible electric motor 58 that is interconnected with a gear reducer 60. Gear reducer 60 is mounted to a relatively thin flexure plate 62 that extends upwardly and spaced apart from upwardly extending leg 56 of antenna 20. A plate support 64, which extends orthogonally between upwardly extending leg 56 and the lower portion of flexure plate 62, securely fastens flexure plate 62 to antenna 20 so that the output shaft 66 of gear reducer 60 extends orthogonally from flexure plate 62.

Extending from output shaft 66 of gear reducer 60 is a dielectric drive rod 68. As is indicated in both FIGS. 2 and 4, output shaft 66 and dielectric drive rod 68 are spaced apart from antenna 20 and extend substantially parallel to horizontally extending leg 34 of antenna 20. Extending outwardly from and coaxial with dielectric drive rod 68 is a threaded shaft 70. As can best be seen in FIG. 3, threaded shaft 70 is engaged with a threaded opening 72 in a pillar 74 that extends angularly from horizontally extending leg 34 of antenna 20. The portion of threaded shaft 70 that extends beyond pillar 74 extends through an opening 76 in capacitor plate 40, with the end of threaded shaft 70 bearing against dielectric plate 48.

As previously mentioned, the spring-like semi-rigid structure of antenna 20 and elastic band 46 act in combination to exert a restoring force on the two segments of horizontally extending leg 34 of antenna 20 to thereby urge capacitor plates 38 and 40 toward one another. Thus, when motor-drive assembly 54 is operated so that the threaded rod 70 exerts no force on dielectric plate 48, capacitor plates 38 and 40 are maintained in a quiescent position of maximum capacitance (minimum resonant frequency of antenna 20). To tune antenna 20 to a higher frequency, motor-drive assembly 54 is operated so that threaded rod 70 bears against dielectric plate 48, slightly flexing upwardly extending antenna arms 32 and 56 away from one another to thereby increase the distance between capacitor plates 38 and 40. As previously mentioned, when this occurs, excess dielectric gel 54 that extends beyond the periphery of capacitor plates 38 and 40 is drawn into the gaps between dielectric plate 48 and capacitor plates 38 and 40 to maintain substantially uniform dielectric layers.

It will be recognized that operating motor-drive unit 54 to increase the distance between capacitor plates 38 and 40 in the above-described manner causes gear reducer 60 and motor 58 to be pulled toward pillar 74. That is, when motor-drive assembly 54 is operated to rotate threaded shaft 70 so that it forces capacitor plates 38 and 40 apart, tension is exerted on gear reducer 60 by threaded shaft 70 and dielectric drive rod 68. This causes flexure plate 62 to spring slightly toward upwardly extending leg 56 of antenna 20. When motor-drive unit 54 is operated to decrease the frequency to which the antenna 20 is tuned, threaded shaft 70 is rotated so that the force exerted on dielectric plate 48 is decreased. As the spring-like antenna structure and elastic band 46 moves capacitor plates 38 and 40 toward one another, flexure plate 62 springs back toward its normal position.

Although not shown in the Figures, it will be recognized by those skilled in the art that the above-discussed operation of motor-drive unit 54 easily can be accomplished by a simple switch arrangement that reverses the polarity of a direct current operating voltage that is supplied to motor 58. To facilitate interconnection of motor 58 with such a switching arrangement and a battery or other conventional direct current power source, a cable 80 that supplies electrical power to motor 58 extends through an opening 82 that is included in upwardly extending leg 56 of antenna 20 at a position near motor 58. Cable 80 is threaded along the interior of conductor 22 of antenna 20 and extends outwardly through an opening 84 in leg 24 of antenna 20 that is located near coaxial cable 26.

It will be recognized by those skilled in the art that the above-described embodiment of the invention minimizes the number of ohmic junctions and, hence, provides maximum antenna efficiency. It also will be recognized that integral capacitor 36 is amenable to low cost fabrication and provides a relatively high working voltage to thereby allow high power antenna operation. Since the force required to move capacitor plates 38 and 40 toward and away from one another is established by the spring-like semi-rigid configuration of antenna 20 and elastic band 46, motor-drive assembly 54 can utilize a low cost reversible electric motor. Moreover, the spring-like semi-rigid structure of antenna 20, elastic band 46 and the viscous damping provided by dielectric gel 54 allow antenna 20 to be tuned rapidly and precisely without overshooting a desired frequency or oscillation about the desired frequency.

Figure 5:
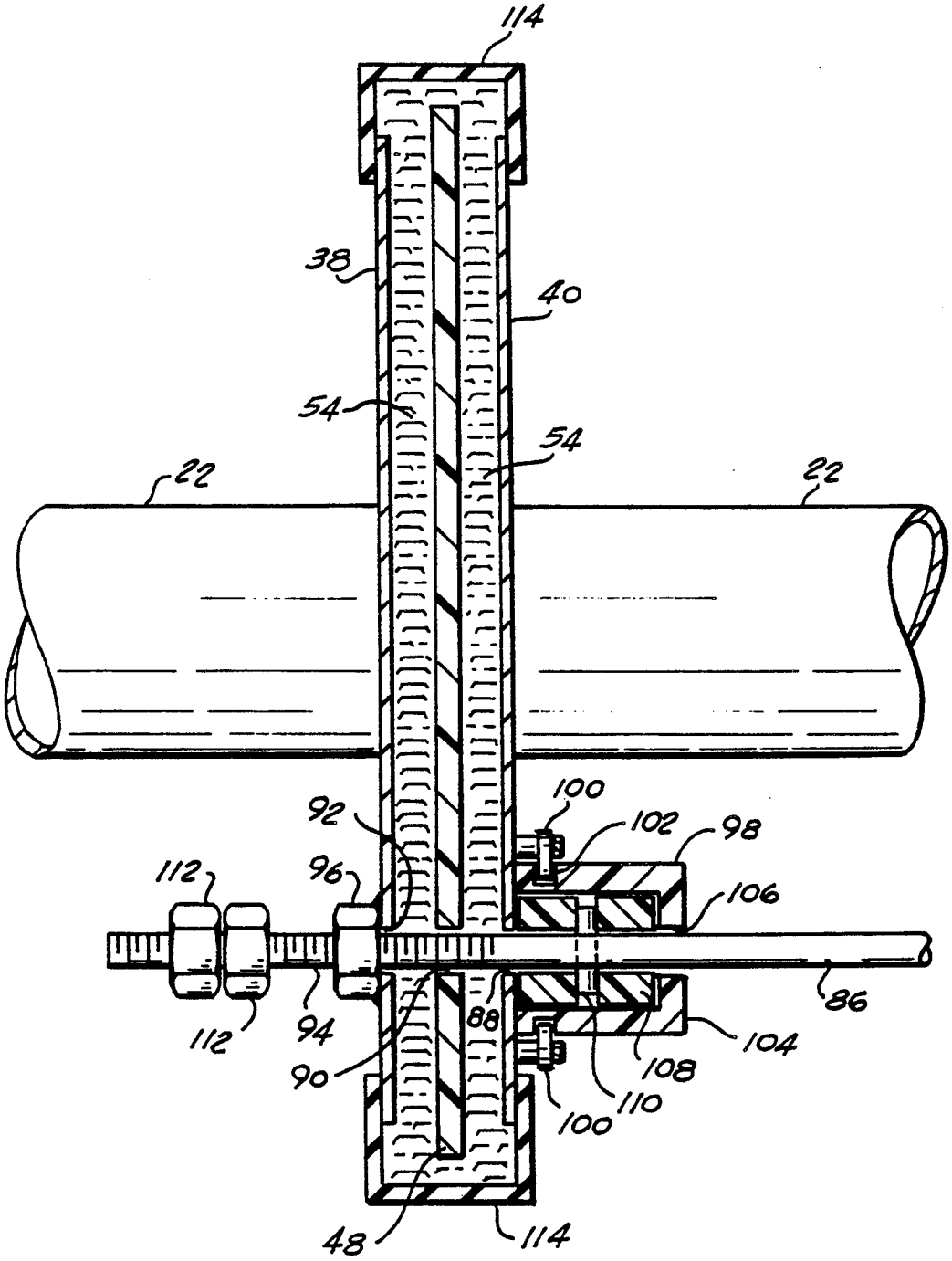
FIG. 5 illustrates an alternative embodiment of the motor-drive assembly of FIG. 4.

Other arrangements may be employed to rapidly and accurately position capacitor plates 38 and 40 and, hence, tune antenna 20 to a desired operating frequency. For example, FIG. 5 illustrates an alternative embodiment of antenna 20 that provides precise tuning of capacitor 36 without relying upon the spring-like qualities of antenna 20 or elastic band 46 for movement of capacitor plates 38 and 40 toward one another when motor-drive unit 54 is operated to decrease the operating frequency of antenna 20. In the arrangement of FIG. 5, the spacing between capacitor plates 38 and 40 is controlled by a drive shaft 86 that is coupled to gear reducer output shaft 66 (not shown in FIG. 5). As is shown in FIG. 5, drive shaft 86 passes through aligned openings 88, 90, and 92 of capacitor plate 40, dielectric plate 48 and capacitor plate 38 (respectively). The end of drive shaft 80 that passes through capacitor plate 38 includes a threaded region 94 that engages with a nut 96 that is welded or otherwise affixed to the outer surface of capacitor plate 38. Extending outwardly from the outer surface of capacitor 40 and concentrically positioned about drive shaft 80 is a substantially cylindrical housing 98. To secure cylindrical housing 98 to capacitor plate 40, the embodiment of FIG. 5 includes a plurality of clamping devices 100 that extend orthogonally from capacitor plate 40 and are circumferentially spaced apart from one another. The clamping devices 100 shown in FIG. 5 are of the type that includes a cam-like member that is rotatable for engagement with a groove 102 in the outer surface of cylindrical housing 98. The end of cylindrical housing 98 that is positioned away from capacitor plate 40 forms an end wall 104 that includes a centrally located opening 106 that is aligned with opening 88 in capacitor plate 40, thereby allowing for passage of drive shaft 86. A cylindrical spool 108 occupies the annular region defined between drive shaft 86 and the interior of cylindrical housing 98. Spool 108 is secured for rotation with drive shaft 86 by a pin 110 that extends radially through spool 108 and drive shaft 86.

In the arrangement of FIG. 5, spool 108 is dimensioned for relatively close fit within the annular region formed between drive shaft 86 and cylindrical housing 98. Thus, when drive shaft 86 is rotated in one direction (e.g., clockwise) by gear reducer 60 and motor 58, capacitor plates 38 and 40 in effect are squeezed toward one another. That is, rotation of threaded region 94 of drive shaft 86 in nut 96 urges capacitor plate 38 toward capacitor plate 40. Simultaneously, one end of spool 108 bears against the outer surface of capacitor plate 40 to urge capacitor plate 40 toward capacitor plate 38. On the other hand, when drive shaft 86 is rotated in the opposite direction (e.g., counterclockwise), the opposite end of spool 108 bears against the inside surface of end wall 104 of cylindrical housing 98 to urge capacitor plate 40 away from capacitor plate 38 and, simultaneously, rotation of threaded region 94 of drive shaft 86 in nut 96 urges capacitor plate 38 away from capacitor plate 40. To limit the maximum spacing between capacitor plates 38 and 40 that can be attained by rotation of drive shaft 86, the embodiment shown in FIG. 5 includes a pair of jam nuts 112 that are installed to the portion of threaded region 94 that extends through nut 96.

The arrangement shown in FIG. 5 also includes an annular flexible boot 114 that is substantially U-shaped in cross-sectional geometry and is installed to circumferentially surround capacitor plates 38 and 40. Boot 114, which is formed of silicone rubber or other such material, forms a reservoir for dielectric grease 54 and, in addition, is useful in protecting against contamination of the dielectric grease by rain, dust or dirt.

It should be recognized by those skilled in the art that various modifications and changes can be made in the disclosed embodiments without departing from the scope and the spirit of the invention. For example, embodiments of the invention have been constructed in which a dish-shaped glass dielectric was mounted to cover the inner surface and surround the peripheral edge regions of one of the capacitor plates and an air gap was formed between the glass dielectric and the second capacitor plate. Other capacitor arrangements also can be employed. For example, a fixed-plate capacitor can be employed in which the dielectric material is altered to tune the antenna. In one such arrangement, the capacitor in effect forms a container and a liquid dielectric is pumped into and out of the capacitor to control the amount of air and liquid dielectric between the capacitor plates.

The embodiments of the invention in which an exclusive property or privilege is claimed are defined as follows:

1. An antenna comprising:

a conductor formed in a loop, said conductor having first and second ends positioned in spaced-apart juxtaposition with one another, said loop exhibiting flexure that allows the spacing between said first and second ends of said conductor to be varied;

first and second capacitor plates respectively mounted in electrical continuity with said first and second ends of said conductor;

a dielectric plate, said dielectric plate being positioned between said first and second capacitor plates with gaps being formed between said first and second capacitor plates and said dielectric plate;

a viscous dielectric gel that is adherent to said first and second capacitor plates and is disposed between said first and second capacitor plates and said dielectric plate; and means for flexing said loop formed by said conductor to vary the spacing between said first and second capacitor plates and thereby tune said antenna to a desired operating frequency.

2. The antenna of claim 1, wherein the dielectric constant of said dielectric plate is substantially equal to the dielectric constant of said dielectric gel.

3. The antenna system of claim 1, wherein said dielectric plate extends outwardly beyond the periphery of said first and second capacitor plates and wherein said viscous dielectric gel that is disposed between said first and second capacitor plates extends outwardly beyond the periphery of said first and second capacitor plates.

4. The antenna of claim 1, further comprising a spring member, said spring member being mounted to said antenna for establishing a restorative force to urge said first and second ends of said conductor toward one another when said means for flexing said loop forces said first and second ends of said conductor away from one another.

5. The antenna of claim 4, wherein said spring member is an elastic band.

6. The antenna of claim 1, wherein said means for flexing said loop formed by said conductor includes a motor-drive assembly, said motor-drive assembly being mounted to said antenna and including a drive rod for pushing said first and second capacitor plates away from one another.

7. The antenna of claim 1, wherein said means for flexing said loop formed by said conductor to vary the spacing between said first and second capacitor plates includes a motor-drive unit, said motor-drive unit including a reversible motor and a drive shaft that is rotated by said reversible motor, said drive shaft extending through openings in said first and second capacitor plates, the opening in said first capacitor plate including threads, said drive shaft including a threaded region engaged with said threads of said opening in said first capacitor plate, said second capacitor plate including means for urging said second capacitor plate toward said first capacitor plate when said drive shaft is rotated in a first direction and for urging said second capacitor plate away from said first capacitor plate when said drive shaft is rotated in the opposite direction.

8. A tunable antenna of the type including a conductor, said conductor having first and second ends and being formed as a substantially planar loop with said first and second ends of said conductor being spaced apart from one another, said tunable antenna further including a pair of first and second capacitor plates that respectively extend outwardly from and surround said first and second ends of said conductor, said tunable antenna being characterized in that said substantially planar loop exhibits a spring-like characteristic that allows the spacing between said first and second capacitor plates to be varied by flexing said loop in a manner that urges said first and second capacitor plates toward and away from one another; said tunable antenna being further characterized by a dielectric plate that is supported between said first and second capacitor plates and by a dielectric gel that is disposed between said first and second capacitor plates and said dielectric plate.

9. The tunable antenna of claim 8 further characterized in that said dielectric plate extends outwardly beyond the periphery of said first and second capacitor plates and in that said viscous dielectric gel that is disposed between said first and second capacitor plates and said dielectric plate extends outwardly beyond the periphery of said first and second capacitor plates.

10. The tunable antenna of claim 9 further characterized in that a motor-drive unit is mounted to said tunable antenna for selectively moving said first and second capacitor plates toward and away from one another to thereby tune said tunable antenna to a desired operating frequency.

11. The tunable antenna of claim 8 further characterized in that flexing said loop formed by said conductor to urge said first and second capacitor plates toward and away from one another is the sole means available for tuning said tunable antenna to a desired operating frequency.

* * * * *